US010328334B2

(12) United States Patent
Borg

(10) Patent No.: US 10,328,334 B2
(45) Date of Patent: Jun. 25, 2019

(54) TILTING PROJECTILE GAME

(71) Applicant: Chris Borg, Huntington Beach, CA (US)

(72) Inventor: Chris Borg, Huntington Beach, CA (US)

( * ) Notice: Subject to any disclaimer, the term of this patent is extended or adjusted under 35 U.S.C. 154(b) by 0 days.

(21) Appl. No.: 15/530,638

(22) Filed: Feb. 14, 2017

(65) Prior Publication Data

US 2018/0229107 A1 Aug. 16, 2018

(51) Int. Cl.

| | |
|---|---|
| ***A63F 7/00*** | (2006.01) |
| ***A63F 7/28*** | (2006.01) |
| ***A63F 7/38*** | (2006.01) |
| *A63F 7/34* | (2006.01) |

(52) U.S. Cl.

CPC ..... *A63F 7/0005* (2013.01); *A63F 7/0017* (2013.01); *A63F 7/28* (2013.01); *A63F 7/38* (2013.01); *A63F 2007/341* (2013.01)

(58) Field of Classification Search

CPC ..... A63F 7/00; A63F 7/0005; A63F 7/0612; A63F 7/0017; A63F 7/28; A63F 7/38; A63F 2007/341; A63D 3/00; A63D 3/02

See application file for complete search history.

(56) References Cited

U.S. PATENT DOCUMENTS 1,768,016 A * 6/1930 Walker ..... A63F 7/386 273/110
2,749,575 A * 6/1956 Toenniessen ..... D01H 5/46 19/267
3,188,087 A * 6/1965 Larson, Jr. ..... A63B 21/0004 273/115
3,479,033 A * 11/1969 Crisafulli ..... A63F 7/386 273/110
3,787,055 A * 1/1974 Kraemer ..... A63F 7/386 273/110
3,879,039 A * 4/1975 Holden ..... A63F 7/0017 273/110
3,967,824 A * 7/1976 Lund ..... A63F 7/386 273/110
4,055,341 A * 10/1977 Martinez ..... A63F 7/386 273/110
4,257,600 A * 3/1981 Goldfarb ..... A63F 7/386 273/110
5,435,555 A * 7/1995 Fuhrer ..... A63F 7/3622 273/110
7,543,818 B2 * 6/2009 Borg ..... A63F 7/00 273/110
2002/0008354 A1 * 1/2002 Lorenz ..... A63F 7/386 273/119 R
2007/0187887 A1 * 8/2007 Borg ..... A63F 7/00 273/109

* cited by examiner

*Primary Examiner* — Raleigh W Chiu

(57) ABSTRACT

This is an improvement to the tilting projectile game of U.S. Pat. No. 7,543,818 B2, in which the tilting assemblies that connect the paddles to the game's base and allow the paddles to tilt in every direction while preventing the paddles from touching one another, have been strengthened, simplified and made more efficient by replacing relatively complex parts with a single, stronger and simpler piece. By enclosing the space between the paddles and base, this improvement also ensures that players cannot put their fingers between those moving parts when the game is being played, whereas in the game's original design, if a player did not hold the paddles in the proper manner, they could misplace their fingers into that space.

1 Claim, 6 Drawing Sheets

TILTING PROJECTILE GAME

This is an improvement to U.S. Pat. No. 7,543,818 B2, a tilting projectile game that can be played by 1 to 4 people and consists of one or more spherical projectiles, a base, 4 paddles and 4 paddle tilting assemblies which connect the paddles to the base in a 2×2 array.

CROSS-REFERENCE TO RELATED APPLICATIONS application Ser. No. 11/354,649

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This is an improvement to the tilting projectile game of U.S. Pat. No. 7,543,818 B2, in which the tilting assemblies that connect the paddles to the game's base and allow the paddles to tilt in every direction, have been strengthened, simplified and made more efficient by replacing relatively complex parts with a single, stronger and simpler piece. By enclosing the space between the paddles and base, this improvement also ensures that players cannot put their fingers between those moving parts, whereas in the game's original design, if a player did not hold the paddles in the proper manner, they could misplace their fingers into that space.

BRIEF SUMMARY OF THE INVENTION

The tilting projectile game of U.S. Pat. No. 7,543,818 B2 consists of one or more marble-like spherical projectiles, a base, 4 paddles and 4 paddle tilting assemblies. The paddle tilting assemblies connect the paddles to the base in a 2×2 array, with a narrow gap between the interior edges of the paddles. Rails along the outer edges of each paddle form a rail around the perimeter of the 2×2 paddle array, which acts to prevent the projectiles from falling off the outer edge of the array. Each paddle has a number of holes, with a diameter large enough for the projectiles to pass through, and the base is shaped to channel the spherical projectile into retrieval areas at the end of the base after the projectile has fallen below the paddles. Each paddle includes a control knob which can be moved vertically and/or turned. When the control knob of a paddle is moved in such a manner, the paddle tilting assembly of that paddle enables the paddle to be tilted in every direction while preventing the paddles from touching each other. By manipulating the paddles when a projectile is on them, the projectile can be moved around the paddle array. The game can be played in a cooperative mode where the players attempt to move the projectile around the array in a given pattern while trying to avoid having the projectile fall through the holes in the paddles, or in a competitive mode where opposing players try to get the projectile to fall through the holes in their opponent's paddle. This invention improves the game by strengthening and simplifying the paddle tilting assemblies. That improvement is accomplished by replacing a number of moving parts in the paddle tilting assembly with a single, simpler and stronger piece. That change also makes the game easier to make and reduces the cost of production. Furthermore, this improvement encloses the space between the paddles and base, ensuring that players cannot put their fingers between those moving parts. In the game's original design, if a player did not hold the paddles in the proper manner, they could misplace their fingers into that space and exposed them to those moving parts.

BRIEF DESCRIPTION OF THE SEVERAL VIEWS OF THE DRAWING

FIG. 15 is a front view of FIG. 14, showing the two slots which the control knob shafts of FIG. 10 pass through.

DETAILED DESCRIPTION OF THE INVENTION

Figure 1:
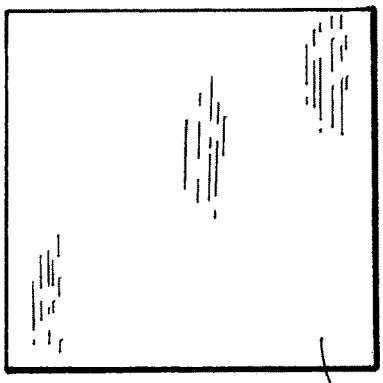
FIG. 1 is a front view of the paddle tilting assembly support. There is a total of 4 of these supports.
Figure 2:
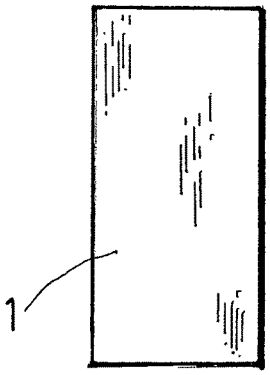
FIG. 2 is a side view of FIG. 1.
Figure 3:
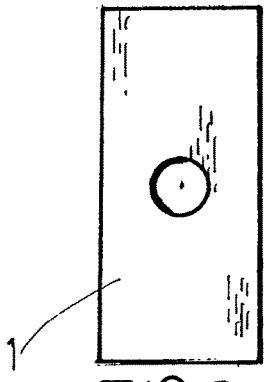
FIG. 3 is a top view of FIG. 1 and FIG. 2, showing the hole in which the cylindrical shaft of the paddle tilting assembly stud of FIG. 6 is inserted, securing it to the support.
Figure 4:
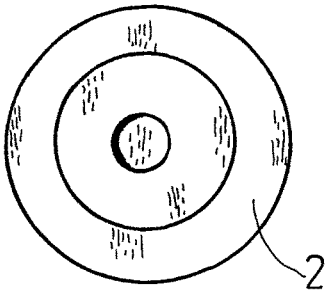
FIG. 4 is a bottom view of the paddle tilting assembly pad, showing its spherical socket.
Figure 5:
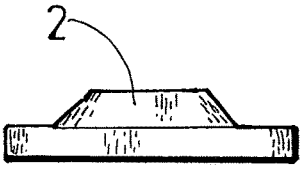
FIG. 5 is a side view of FIG. 4.
Figure 6:
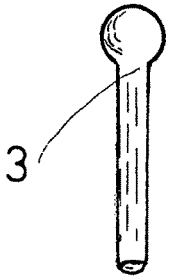
FIG. 6 is a front view of the paddle tilting assembly stud showing its cylindrical shaft and spherical top.
Figure 7:
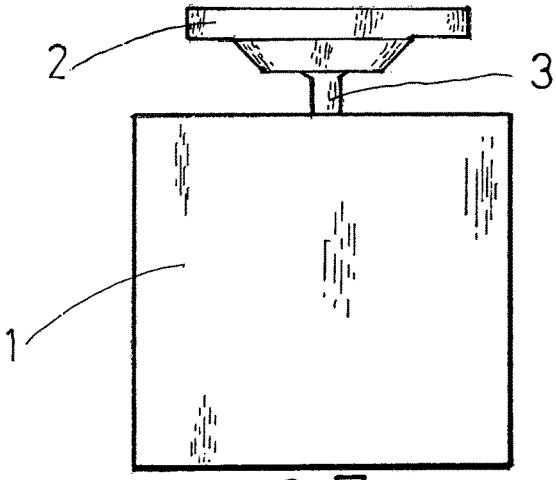
FIG. 7 is a front view of a complete paddle tilting assembly, showing the shaft of the assembly's stud inserted into the hole of the assembly support and the spherical top of the stud inserted into the hole of the assembly pad.
Figure 8:
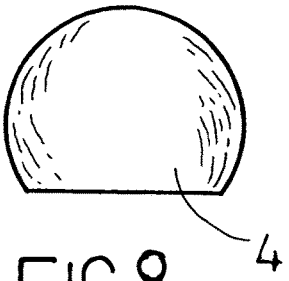
FIG. 8 is a side view of the paddle control knob.
Figure 9:
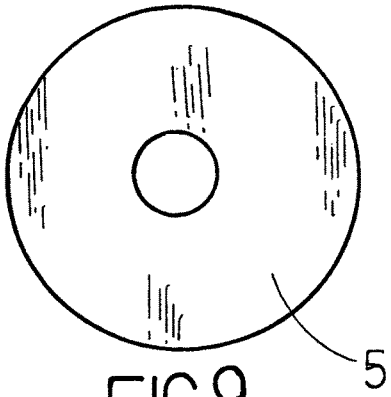
FIG. 9 is a front view of the control knob guard.
Figure 10:
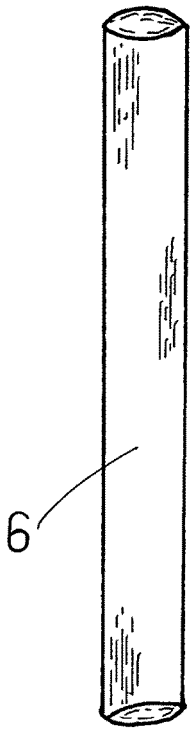
FIG. 10 is a front view of the control knob shaft.
Figure 11:
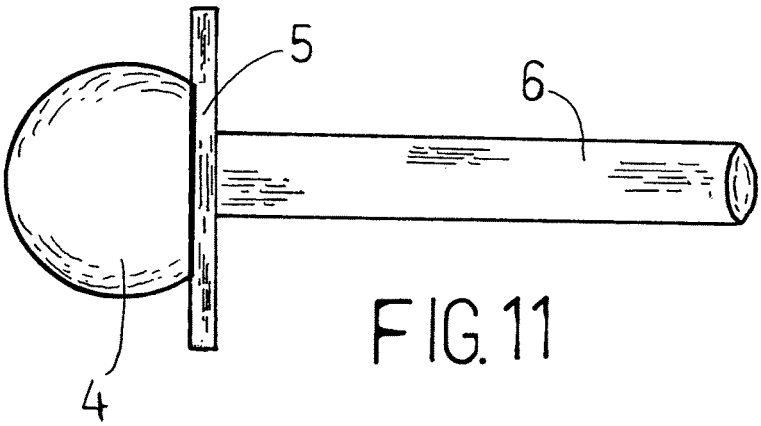
FIG. 11 is a side view of the complete control knob assembly, showing the control knob guard connected to the control knob, and the control knob shaft inserted through the hole in the control knob guard and into a hole in the control knob.
Figure 12:
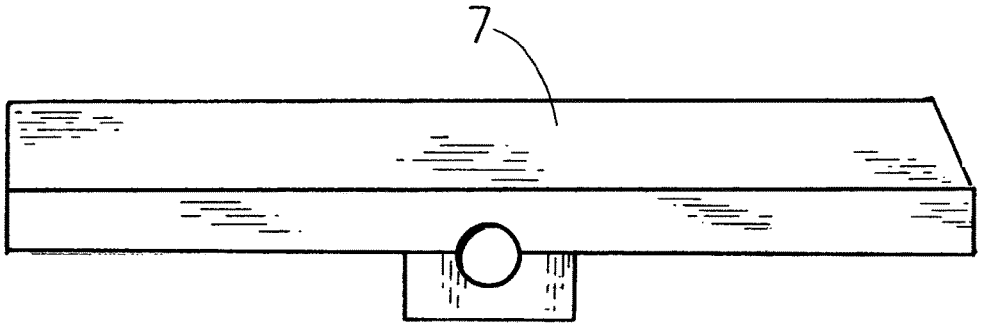
FIG. 12 is a side view of a paddle, showing a paddle rail attached to the top of the paddle base and a hole into which the control knob shaft will be inserted.
Figure 13:
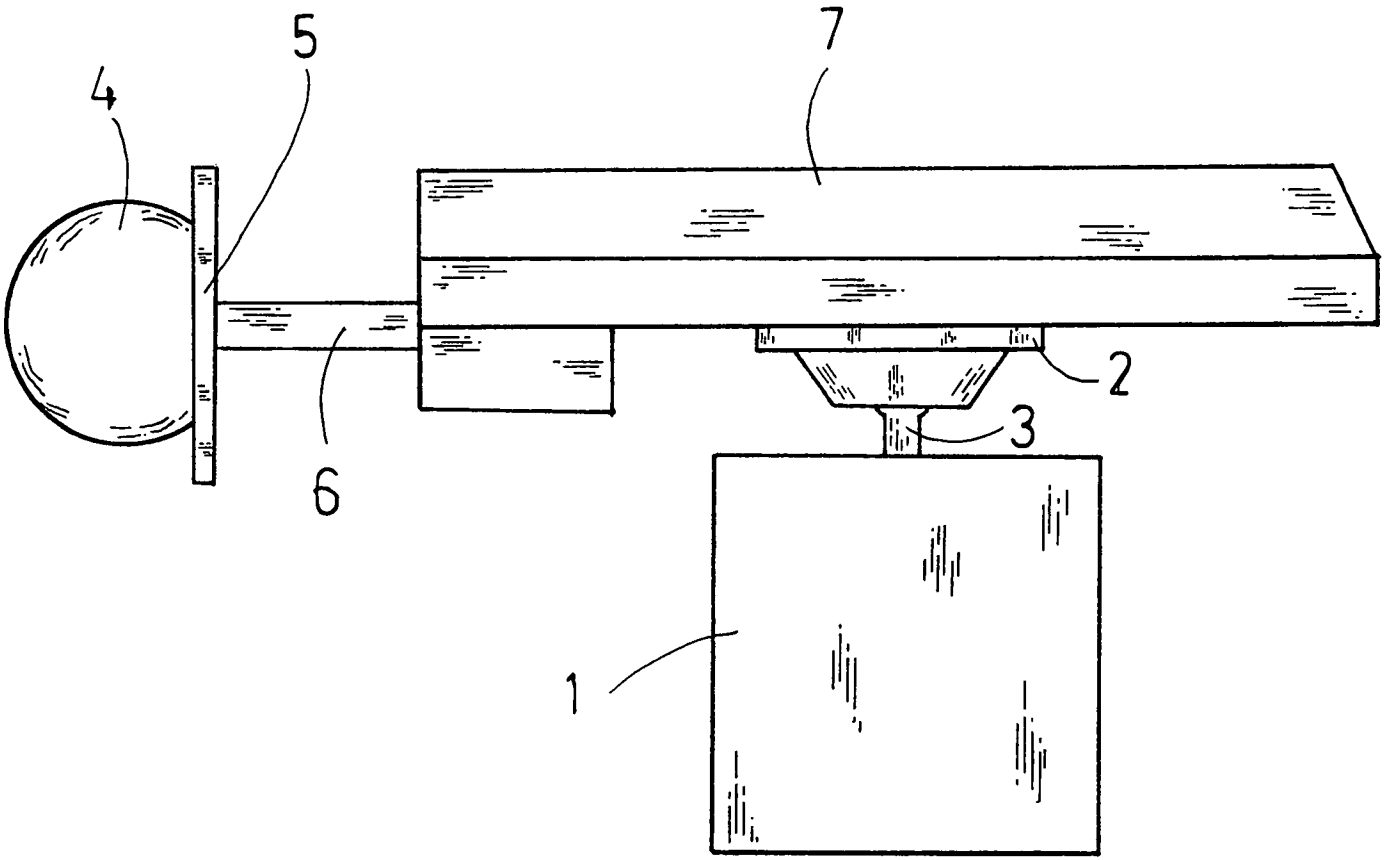
FIG. 13 shows a complete tilting assembly attached to a paddle via the assembly pad and the control knob shaft inserted into the side of a paddle.
Figure 14:
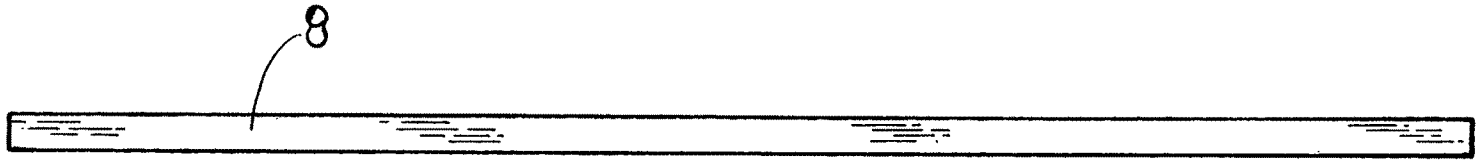
FIG. 14 is a top view of the game side.
Figure 15:
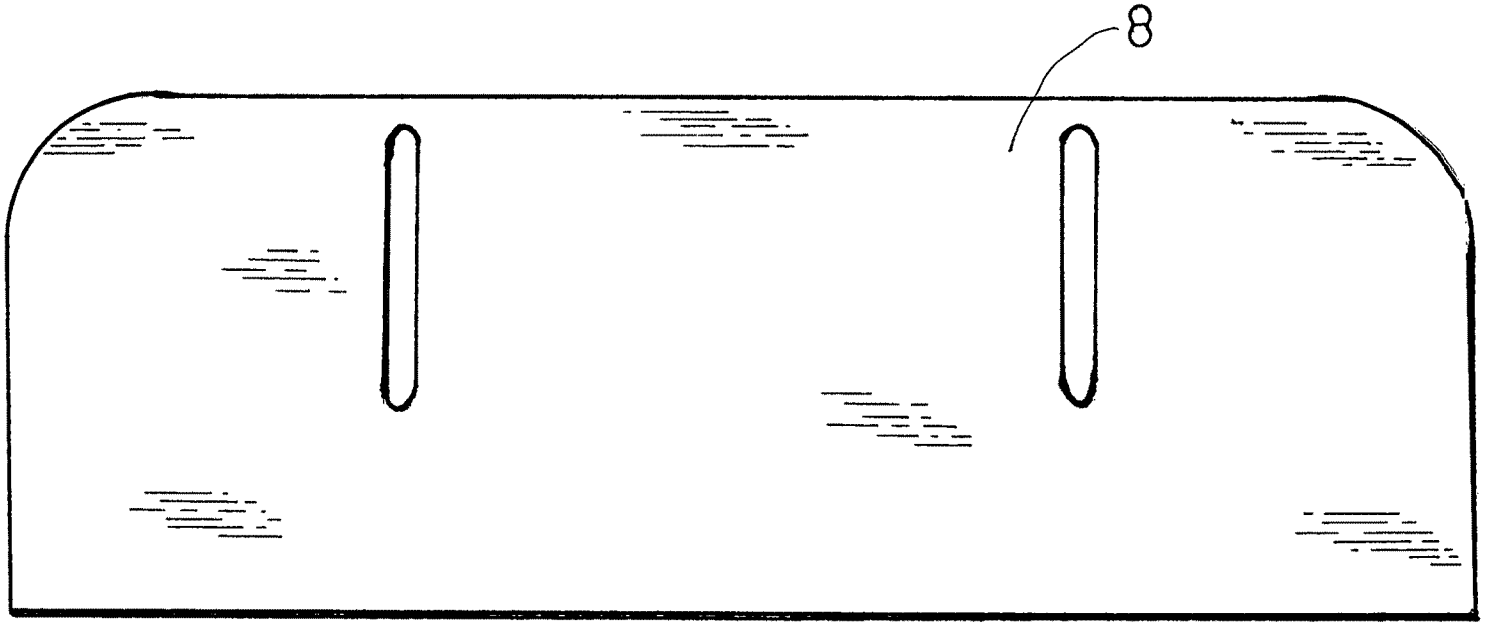
Figure 16:
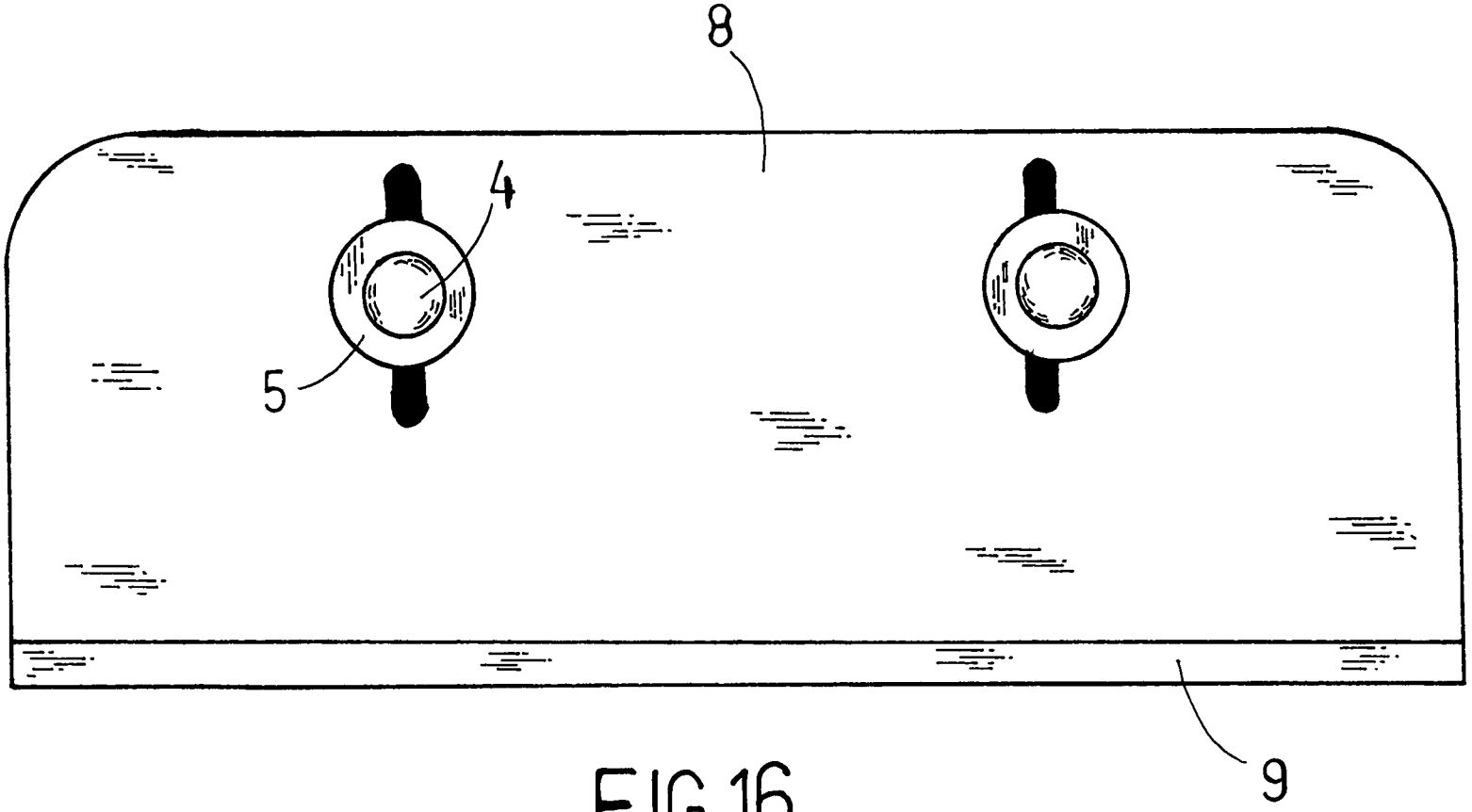
FIG. 16 is a front view of the side of the game, showing the game side of FIG. 15 attached to the game base, and the completed control knob assembly of FIG. 11 positioned on the outside of the game side, with the control knob shaft which passes through the game side and connects the control knob to the paddle of FIG. 12 not seen.
Figure 17:
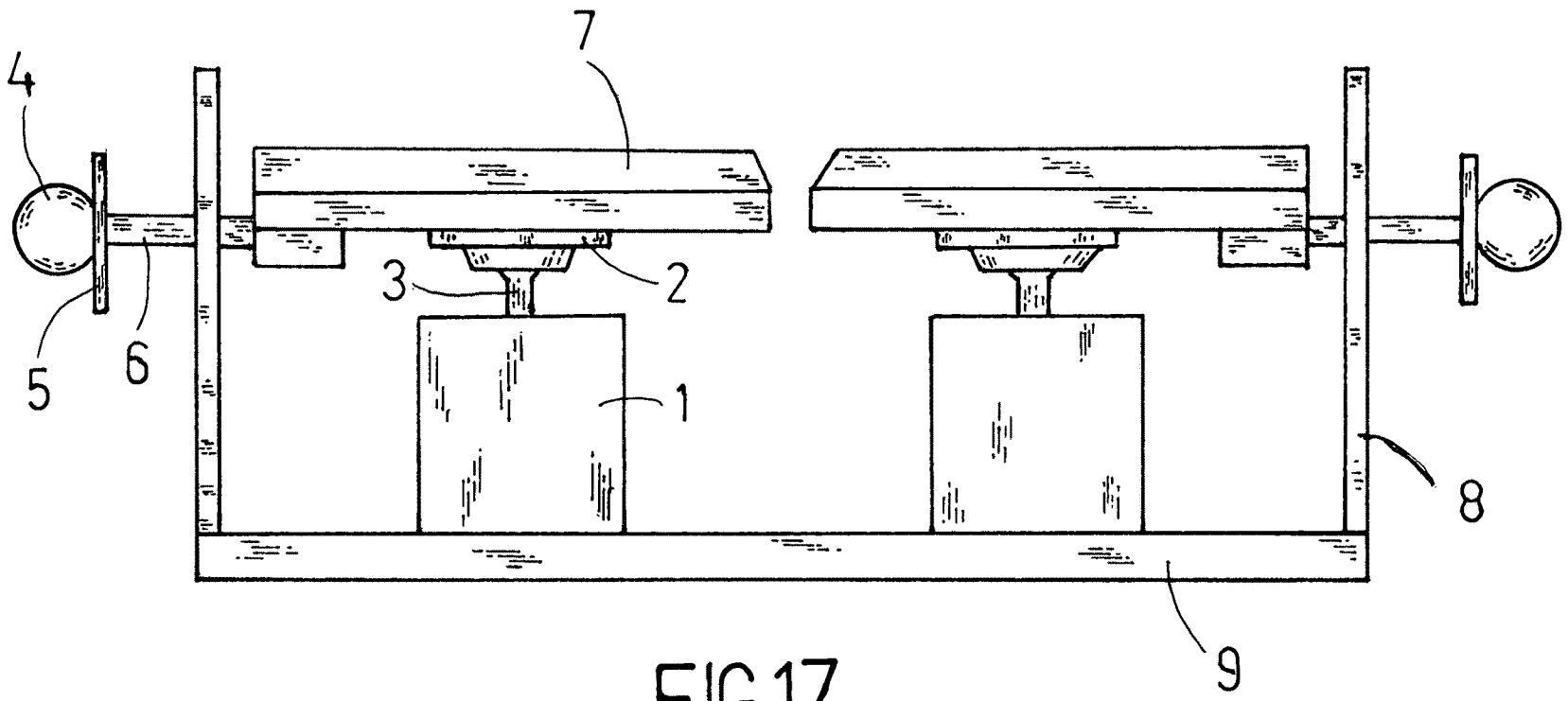
FIG. 17 is a front view of the end of the game, with the game sides of FIG. 14 and FIG. 15, and the completed paddle tilting assemblies of FIG. 13 attached to the game base, with the control knob shafts of FIG. 10 shown passing through the game sides.

Being an improvement to an existing invention, (U.S. Pat. No. 7,543,818 B2), this description focuses on those improvements, as the rest of the invention remains unaltered. The improvements have been made to the paddle tilting assemblies which connect the paddles of the game to the game's base in a 2×2 array, with a narrow gap between the inner edges of the paddles. In order for the game to function properly, the paddles must be able to freely tilt in all directions, but be prevented from contacting each other. In the patented version of this game, the omnidirectional tilting requirement is achieved by attaching a pad which has a spherical socket in it, to the center of the underside of the paddle. The top end of a stud with a ball on top was inserted into the socket while the other end of the stud was attached to a support which was connected to the game's base. This ball and socket arrangement enabled the paddles to tilt in all directions. To prevent the paddles from coming in contact with each other, the pad connected to the underside of the paddle included a number of other spherical sockets. Into each of those sockets, the top end of another stud with a ball on top was inserted while the shafts of those studs were inserted into vertical holes in the support. These stud shafts move vertically in the support holes in a piston/cylinder like fashion, which still allows the paddles to freely tilt in every direction, but stops the paddles from turning into one another. Although this arrangement of multiple ball and sockets per paddle is effective, it is relatively complex and costly to construct since a number of moving parts are involved, those parts need to be correctly aligned and they are subject to wear through usage. The following is a description of the improvements made to the game to overcome those shortcomings. The need for more than a single ball and socket assembly for each paddle was eliminated by extending the control knob 4 as shown in FIG. 11, where the control knob shaft 6 is inserted between the paddle 7 and the knob. That shaft passes through a vertical slot in the game side 8 as shown in FIG. 16 and FIG. 17. The slot is slightly wider than the shaft's width, so the shaft can easily be moved up and down in the slot but it cannot be moved horizontally. The shaft of the paddle tilting assembly stud 3 of FIG. 6 is connected to the top of the paddle tilting assembly support 1 of FIG. 1 while the bottom of the support is attached to the game base 9 as shown in FIG. 17. With the pivot point of the single ball and socket assembly 2, 3 of FIG. 7 centered on the underside of the paddle, combined with the shaft through slot design of the game's side shown in FIG. 16 and FIG. 17, the paddles can be freely tilted in all directions but cannot come in contact with each other. This improved arrangement eliminates a number of moving parts and eases construction while making the game more robust and durable. Beyond those benefits, this improved design eliminates the possibility of a player putting their fingers into an area of the game where they should not be. In the game's original form, if a player did not hold the paddles by the control knobs as they were intended to do, but instead held onto the sides of the paddle, they could put their fingers under the paddle where they might come in contact with moving parts while the game was being played. That potential for contact is eliminated with this new design since the heightened sides of the game effectively enclose the space underneath the paddles as shown in FIG. 16 and FIG. 17. To eliminate any possibility of contact between moving parts on the outside of the game, a finger guard 5 is attached to the inner end of the control knob, ensuring separation between a player's fingers and the game's sides.

While there has been shown and described a preferred embodiment of the improvements to the tilting projectile game of U.S. Pat. No. 7,543,818 B2, it is understood that changes in structure, materials, sizes and shapes can be made by those skilled in the art without departing from those improvements. The improvements to the invention are defined in the following claims.

I claim:

1. An improved tilting projectile game comprising: 4 paddles; a base and sides;

4 paddle tilting assemblies connecting the paddles to the base in a closely grouped 2×2 array in which the inner edges of side-by-side paddles are parallel or approximately parallel, each said paddle tilting assembly including a control knob and a shaft, said shaft connecting the control knob to the paddle and passing through slots in said sides which allows said paddles to be tilted in every direction while preventing said paddles from touching each other; each said paddle tilting assembly further including a guard to prevent fingers from being placed between the knobs and the sides of the game; and, one or more spherical projectiles, with said projectiles having a diameter which allows them to pass through holes in said paddles, and upon doing so, the said base guides said projectiles into retrieval areas at the ends of said base.

* * * * *